US007407258B2

(12) United States Patent
Nakahara et al.

(10) Patent No.: US 7,407,258 B2
(45) Date of Patent: Aug. 5, 2008

(54) INK JET RECORDING METHOD, RECORDING APPARATUS, AND RECORDED OBJECT

(75) Inventors: Yasunori Nakahara, Tokyo (JP); Junichi Sakurai, Kanagawa (JP)

(73) Assignee: Canon Finetech Inc., Misato-Shi, Saitama (JP)

( * ) Notice: Subject to any disclaimer, the term of this patent is extended or adjusted under 35 U.S.C. 154(b) by 294 days.

(21) Appl. No.: 11/222,298

(22) Filed: Sep. 7, 2005

(65) Prior Publication Data

US 2006/0055715 A1 Mar. 16, 2006

(30) Foreign Application Priority Data

Sep. 13, 2004 (JP) ..... 2004-265465
Oct. 8, 2004 (JP) ..... 2004-296694

(51) Int. Cl.
*B41J 2/165* (2006.01)

(52) U.S. Cl. ..... 347/35; 347/36; 347/23

(58) Field of Classification Search ..... 347/5, 347/9, 14, 19, 23, 24, 35–36
See application file for complete search history.

(56) References Cited

U.S. PATENT DOCUMENTS 5,659,342 A * 8/1997 Lund et al. ..... 347/35
2001/0028371 A1* 10/2001 Su et al. ..... 347/19

FOREIGN PATENT DOCUMENTS

JP 03-45814 9/1991
JP 08-1961 1/1996
JP 09-52374 2/1997
JP 2002-144599 5/2002
JP 2002-225301 8/2002
JP 2004-167852 6/2004

* cited by examiner

*Primary Examiner*—Lam S Nguyen
(74) *Attorney, Agent, or Firm*—patenttm.us

(57) ABSTRACT

In an ink jet recording apparatus, it is detected whether or not an ejection has been performed at least one time while printing an image, with respect to each nozzle, within a predetermined period (preliminary on-paper ejection cycle corresponding to the checking area C1), and the nozzle which has performed the ejection at least one time is excluded from a target of preliminary ejection within a second predetermined period (preliminary on-paper ejection cycle corresponding to the checking area C2) subsequent to the above predetermined period. As for the nozzle not excluded from the preliminary ejection target, the preliminary ejection is performed at least one time onto paper (preliminary on-paper ejection area R2) as to each nozzle at a predetermined timing within the second predetermined period (preliminary on-paper ejection cycle corresponding to the checking area C2). Accordingly, printing is not interrupted by a head recovery processing, and also unnecessary preliminary ejection can be reduced. In the case of a recording medium such as cardboard and envelope, which is processed after recording and changed in shape so as to functionate as desired, the preliminary ejection is performed onto a position defined according to the shape, for example, flap portion (206C), overlap portion (206A), and the like, without exceeding a predetermined density.

5 Claims, 16 Drawing Sheets

INK JET RECORDING METHOD, RECORDING APPARATUS, AND RECORDED OBJECT

FIELD OF THE INVENTION

The present invention relates to an ink jet recording method and apparatus which perform recording on a recording medium, by use of an ink jet recording head which ejects ink (hereinafter, also referred to just as "recording head").

RELATED ART

An ink jet recording method is a method in which ink is ejected from ink discharge openings provided on a recording head, and forms a desired image on a recording medium such as paper, resin film, cloth and metal. This method has various advantages such as being quiet because of non-contact recording onto the recording medium, high in recording speed, further capable of performing high-density recording and easily colorized as well.

Generally, in an ink jet recording apparatus, not all of the discharge openings provided on the recording head are utilized depending on recording data, and sometimes a particular discharge opening is not used at all for a long period of time. Such a non-used discharge opening may have ink solvent inside to evaporate, causing increase of ink viscosity. In this situation, even when a drive signal is applied to an element which generates energy used for ejecting the ink, the ink is not properly ejected and this may cause a distortion of ejecting direction or insufficient ejection amount. In an extreme case, the ink is not ejected at all (hereinafter, referred to as "defective ejection"). Consequently, a desired image may not be obtained.

An action called as a preliminary ejection may be performed as one of operations to remove factors of such defective ejection and to achieve a good performance in ejecting ink from the recording head. This preliminary ejection is to drive an element for ejecting ink, in addition to the recording operation for forming an image, aiming at ejecting ink from the discharge opening, the ink being in a status insufficient to ensure a good ejection performance, and a certain recording quality. Since this preliminary ejection is carried out in order to handle the defective ejection due to evaporation of ink solvent, it is frequently performed, in a case where the environmental temperature is high or a rise in temperature of the recording head is drastic.

The Japanese Patent Laid-open Publication No. H08-1961 discloses an ink jet printer which is designed to perform the preliminary ejection toward a cap which can be brought into intimate contact with a surface of recording head where ink discharge openings are formed.

The Japanese Patent Laid-open Publication No. H09-52374 discloses an ink jet recording apparatus which is provided with a cap member to receive ink droplets being jetted for maintenance of the recording head, and also provided with an ink discharge hole having a window confronting the recording head, the ink discharge hole being arranged in a non-print area that is opposite to the side where the cap member is arranged and within the range of a locus of movement of the recording head, wherein the recording head is moved either to the cap member or to the ink discharge hole, whichever closer, and the preliminary ejection (flashing) is performed.

The Japanese Utility Model Examined Publication No. H03-45814 discloses a method which detects whether or not an ejection signal is applied to a serial type recording head (as a whole) within a predetermined period of time, and if the number of the ejection signals (integrated value) is equal to or less than a set value, a leading edge (margin) in the next main scanning is subjected to the preliminary ejection.

In addition, there is another method for performing the preliminary ejection to a binding margin of a recording medium, in the case where the ejection has not been performed for a predetermined period of time (see the Japanese Patent Laid-open Publication No. 2002-225301, for example).

There is also proposed a method which performs the preliminary ejection to a recording area of a recording medium in a recording head having a high resolution (see the Japanese Patent Laid-open Publication No. 2002-144599, for example).

With regard to the ink jet recording apparatus as described above, needs for industrial use recording have grown, such as recording on cardboard or envelope, utilizing the advantages of the particular recording method. Unlike a personal or office use recording, the industrial use recording frequently performs high volume printing, and thus, demands for increasing speed in recording are particularly high. Therefore, a recording apparatus in a form of line printer is suitable, in which discharge openings are arranged across the length corresponding to the full width of image forming area of the recording medium.

One type of such line printers may be provided with one piece of long-length recording head integrally formed so as to satisfy the above length. Another type may be provided with a combination of plural recording heads to satisfy the length (hereinafter, these recording heads are generically referred to as "full-line head"). In any type of the line printers, it is possible to drive the recording head to perform recording operation while the recording medium is continuously moved, thereby achieving a recording at a speed higher than a so-called serial type ink jet printer, which performs recording operation by alternately repeating, a conveyance of the recording medium by a predetermined amount and a main scanning of the recording head at each position after conveyed.

However, according to any inventions disclosed by the Japanese Patent Laid-open Publications No. H08-1961 and No. H09-52374, it is necessary to interrupt a series of recording operations to allow the recording head to move to a predetermined position so that the preliminary ejection is performed. Therefore, deterioration in recording throughput is unavoidable.

The preliminary ejection in the art described in the Japanese Utility Model Examined Publication No. H03-45814 is to eject ink onto a margin of the paper. Therefore, interruption of printing operation is not necessary, but it is not suitable for the case where recording is performed on a continuous form with no margins, or for the case where recording size is long. In particular, as for a conventional ink jet recording apparatus which employs a long-length type line head being provided with multiple recording elements linearly arranged across the full width of the paper, in many cases, printing operation is maintained continuously for a relatively long period of time, when continuous printing is performed on a continuous form such as roll paper. Therefore, as to a nozzle which has not been subjected to ink ejection for a certain period, viscosity of ink is increased and it may cause defective ejection.

As for the method according to the Japanese Patent Laid-open Publication No. 2002-225301 or No. 2002-144599, the preliminary ejection is performed from all of the nozzles of the recording head each time a certain period of time lapses regardless of the recording operation history. Therefore, ink consumption may be excessive. Particularly in the case of line head type, the number of nozzles is extremely large compared to the serial head type. If both the line head and the serial head perform the preliminary ejection from each nozzle at the same frequency, ink consumption for the preliminary ejection by the line head becomes larger. Especially, if the preliminary ejection is performed from each nozzle at a constant cycle regardless of the image to be printed, it is wasteful.

The method as disclosed by the Japanese Patent Laid-open Publication No. 2002-225301 can be applied to a line head type recording apparatus, but there is apprehension that deterioration of adhesive property on the binding margin may exert a harmful effect.

According to the method as disclosed in the Japanese Patent Laid-open Publication No. 2002-144599, it is general that a line head type recording apparatus is provided with a recording head having at least several thousands of nozzles, and total amount of preliminary ejection becomes large. Therefore, the ejection tends to be conspicuous depending on a size of the image itself, in particular, in a small sized image such as a name card, for example, which is viewed relatively from a close position.

Further according to this method, a period of no ejection is measured with respect to each nozzle, and the preliminary ejection is performed as to the nozzle from which there has been no ejection for a predetermined period, so as to suppress wasteful ink consumption. However, in order to measure the period of no ejection as to the nozzles independently, a time-keeping means (for example, a counter) is required, the number of which corresponds to the number of nozzles. Therefore, there is a problem that the control may become complicated.

Moreover, if the ejection is performed onto the paper simultaneously from all the nozzles of the line head, the data ejected on the paper is placed on the same line, and thus it is also a problem that the ejected data is apt to be visually recognized.

The present invention has been made to solve the problems of the aforementioned conventional arts, and an object of the present invention is to provide an ink jet recording method and apparatus in which printing is not interrupted by head recovery processing, and unnecessary preliminary ejection can be reduced.

Another object of the present invention is to provide an ink jet recording method and apparatus which carry out the preliminary ejection onto paper, suitably designed for a line head.

It is further another object of the present invention to provide an ink jet recording method and apparatus which are capable of performing the preliminary ejection so that ink ejection to a certain portion may not go over a predetermined amount according to a form of the recording medium, in a recording apparatus which employs a recording head for ejecting ink.

SUMMARY OF THE INVENTION

A preliminary on-paper ejecting method according to the present invention is a method in an ink jet recording apparatus provided with an ink jet recording head, comprising the steps of:

performing printing of an image by the recording head based on image data, detecting whether or not an ejection has been performed at least one time within a predetermined period with respect to each nozzle, excluding a nozzle which has performed the ejection at least one time, from a target of a preliminary ejection by a preliminary on-paper ejecting means that is to be performed within a second predetermined period subsequent to the above predetermined period, and performing at least one time preliminary ejection onto paper at a predetermined timing within the second predetermined period, as to the nozzle which has not been excluded from the target of the preliminary ejection.

With the configuration above, it is detected whether or not the ejection has been performed with respect to each nozzle every predetermined period, and if at least one ejection is detected as to a nozzle, the operation of the preliminary on-paper ejection is omitted for that nozzle within the subsequent predetermined period. As for the nozzle which has not performed the ejection at all within the predetermined period, the operation of the preliminary on-paper ejection is performed in the subsequent predetermined period. As thus described, it is decided whether or not the preliminary on-paper ejection is performed in the subsequent predetermined period based on a history of ejections every predetermined period, with respect to each nozzle.

By differentiating the predetermined timing with respect to each nozzle of the recording head, the preliminary on-paper ejection is dispersed widely on the paper area, thereby preventing a quality of printed image from being deteriorated.

The predetermined period is set to be equal to or less than one third of an allowable exposure time of each of the nozzles, whereby a reliable effect of the preliminary ejection can be obtained for each nozzle.

The ink jet recording apparatus according to the present invention includes, a printing means which performs printing of an image by a recording head based on image data, a preliminary on-paper ejection means which performs a preliminary ejection at least one time onto paper from each of all the nozzles of the recording head every predetermined period, an ejected/non-ejected detecting means which detects whether or not an ejection has been performed at least one within a predetermined period with respect to each nozzle while printing the image, and a control means which excludes a nozzle which has performed the ejection at least one time, from a target of the preliminary ejection by the preliminary on-paper ejection means within a second predetermined period subsequent to the predetermined period above.

The ink jet recording apparatus according to another aspect of the present invention being provided with a recording head, includes, a printing means which performs printing of an image by the recording head based on image data, a preliminary on-paper ejection means which performs a preliminary ejection at least one time onto paper with respect to each of all the nozzles of the recording head every predetermined period, according to a predetermined preliminary on-paper ejection pattern, an ejected/non-ejected detecting means which detects whether or not an ejection has been performed within a predetermined period with respect to each nozzle, and a control means which sets the preliminary on-paper ejection pattern as valid in a second predetermined period subsequent to the above predetermined period only for a nozzle determined as non-ejected in the ejected/non-ejected detecting means, and which transfers to the printing means the print data generated based on both the preliminary ejection pattern set as valid and the image data.

More specifically, the control means holds a valid flag which sets a nozzle as valid in performing the preliminary on-paper ejection, the nozzle having been determined as non-ejected by the ejected/non-ejected detecting means, and when the aforementioned print data to be transferred to each recording head is generated, the preliminary on-paper ejection pattern is added to the image data so as to generate the print data, only when the valid flag indicates "valid".

The present invention is preferable when it is applied to an apparatus which uses a line head as a recording head.

It is also possible to prepare as operation mode of the preliminary on-paper ejection, a first preliminary on-paper ejection mode which determines whether or not the preliminary on-paper ejection every predetermined period is necessary based on a detection result of the ejected/non-ejected detecting means, and a second preliminary on-paper ejection mode which performs the preliminary on-paper ejection constantly during printing regardless of the detection result of the ejected/non-ejected detecting means, and the first and the second preliminary on-paper ejection modes are utilized by switching therebetween, according to the number of pixels to be printed by the recording head. With the configuration above, it is possible to prevent a harmful effect in printing an image which is nearly blank paper, in the case where only the first preliminary on-paper ejection mode is employed.

According to the present invention, the preliminary on-paper ejection is employed, and thus printing can be continued until an error occurs such as being out of ink, without interrupting the printing by a recovery process of the recording head. In addition to the above advantage, according to the present invention, since the execution of the preliminary ejection is omitted according to the history of ejections from each of the nozzles, it is possible to reduce an unnecessary preliminary ejection. Therefore, the number of the preliminary ejections can be reduced to a large extent according to an image as a print target, thereby also reducing wasteful ink consumption.

As a condition to decide whether or not the preliminary on-paper ejection is to be performed, it is only detected whether or not each nozzle has been subjected to the ejection every predetermined period. Therefore, the configuration and control thereof can be simplified.

Further, the timing of ejections is differentiated with respect to each nozzle performing the preliminary ejection, whereby the ejected ink can be dispersed onto paper. Accordingly, correlatively with an effect of reduction of the preliminary ejection, degrading of image quality due to the preliminary on-paper ejection can be suppressed.

Further according to another aspect of the present invention, the preliminary ejection is performed onto a certain position determined by a form of the recording medium as a recording target, for example, the position being a flap part or an overlap width of cardboard or envelope sheet whose shape is to be changed by a processing after the recording, so as to functionate as desired. Also, the total amount of ink used by the preliminary ejection is limited. Accordingly, it is possible to prevent in advance, a harmful side effect such as deterioration of adhesive property in shaping process after the recording.

PREFERRED EMBODIMENTS OF THE INVENTION

Hereinafter, preferred embodiments of the present invention will be explained in detail by way of example, with reference to the accompanying drawings. It is not intended that relative positions of constitutional elements, formulas, numerical values, and the like, as described in this embodiment will not limit the scope of the present invention, unless otherwise specified.

Figure 1:
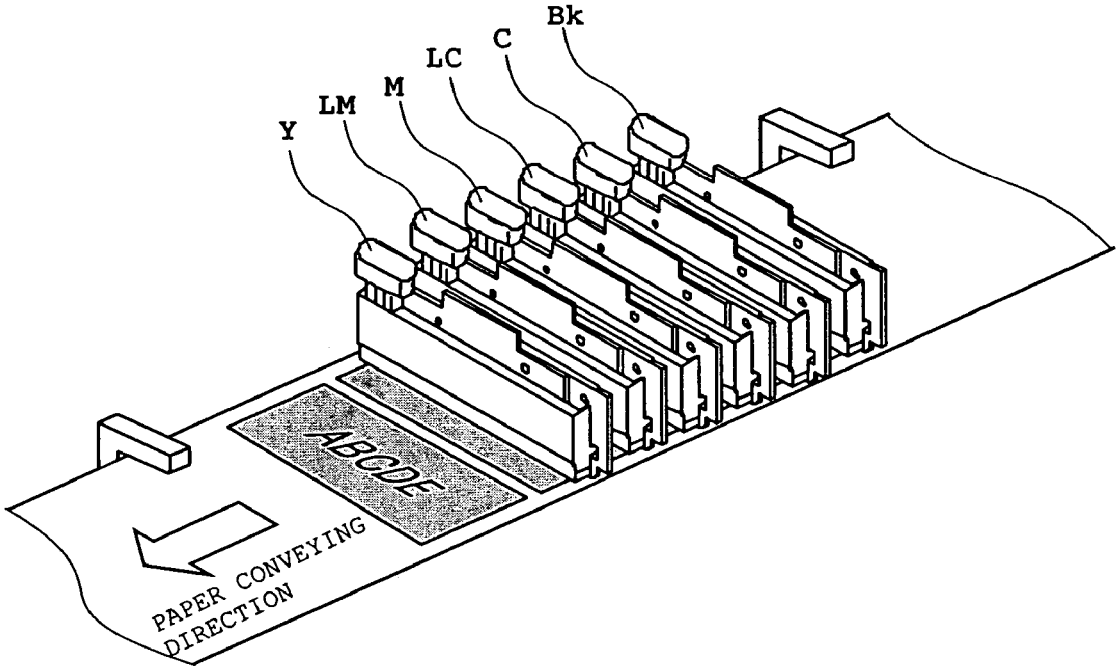
FIG. 1 is a perspective view to schematically explain an array of ink jet recording heads according to a preferred embodiment of the present invention.

FIG. 1 is a perspective view to schematically explain an array of ink jet recording heads according to a preferred embodiment of the present invention.

The recording head as a recording means in the preferred embodiment are formed by arranging a plurality of line heads of long-length type in parallel, each linearly placing a plurality of recording elements, being orthogonal to a direction into which a paper sheet is conveyed. In the example as shown in FIG. 1, the plurality of line heads are respectively provided with six recording heads Bk, C, LC, M, LM, and Y which perform recording by ejecting different colored ink, that is, Black, Cyan, Light Cyan, Magenta, Light Magenta, and Yellow, in this example.

Figure 2:
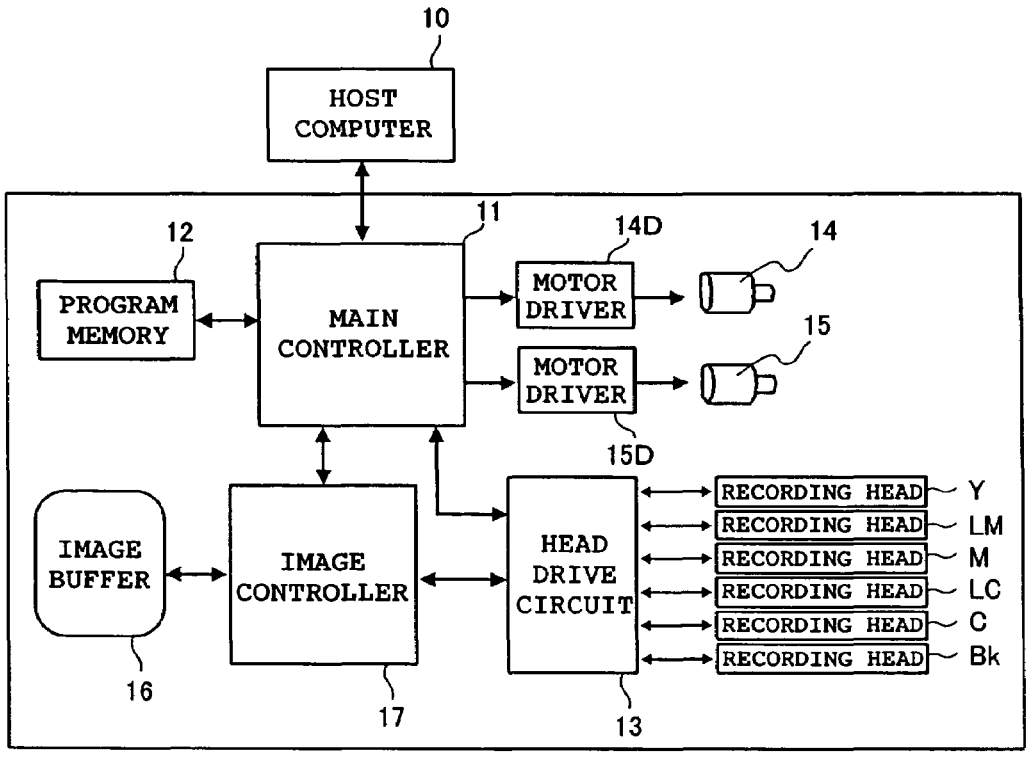
FIG. 2 is a block diagram showing a schematic configuration of hardware for controlling the ink jet recording apparatus relating to one embodiment of the present invention, together with an external host computer.

FIG. 2 is a block diagram showing a schematic configuration of hardware for controlling the ink jet recording apparatus relating to one embodiment of the present invention, together with an external host computer 10. Here, a printer is taken as an example to explain the ink jet recording apparatus, but it is not limited to the printer, and it may be a copy machine, facsimile machine, or the like.

In FIG. 2, main controller 11 is a constitutional element which includes CPU and the like to control the overall recording apparatus, and it functions as a means for controlling other constitutional elements. This main controller 11 is connected to the host computer 10, and signals (including image data) are able be transmitted and received therebetween. Program memory 12 is a memory which is connected to the main controller 11. This program memory 12 stores a control program to control this recording apparatus.

Head drive circuit 13 is a drive circuit which drives a heating element built in the recording head for each color. Motor driver 14D is a drive circuit to drive a head ascent/descent motor 14 which allows the recording head to move to a print position or to a home position (cap position). Motor driver 15D is a drive circuit which drives a recovery system motor 15 provided in a recovery system for executing absorption and discharging of thickened ink existing in a recording head. The main controller 11 controls all of the above elements. The image buffer 16 is a buffer to store the image data which is transmitted from the host computer 10.

Image controller 17 which is connected to the main controller 11 stores the image data transmitted from the host computer 10 into the image buffer 16. When one page of image data is prepared, the main controller 11 allows the motor driver 14D to drive the head ascent/descent motor 14, thereby moving the head from the home position to the print position.

Next, when the paper reaches a position for recording, the image controller 17 connected to the main controller 11 controls the head drive circuit 13 according to the image data recorded in bitmap format, which is stored in the image buffer 16, and forms an image.

In addition, a processing to receive the image data from the host computer 10 and to store thus received image data into the image buffer 16 is carried out in parallel with the processing to print the image, whereby different images can be printed one after another. In order to complete the printing, the head ascent/descent motor 14 is driven to move the head from the print position to the home position, and then printing is completed.

If a recording head for ink-jet use is kept exposed in the air, the ink around the ejection nozzle is dried and thickened due to a property of this type of recording head, and thus it may cause a detective printing. Therefore, if the head is kept exposed for a certain period of time in the ink jet recording apparatus, not only prior to printing but also during printing, it is necessary that the main controller 11 issues a print suspension command to the image controller 17 and performs a head recovery processing. In general, as one of the processing means for recovery, there is a preliminary ejecting means as described above. The preliminary ejection is typically performed by discharging ink from all the ink discharge openings of the nozzles into a preset ink receiver which is provided with an ink absorber and the like. With such preliminary ejection as described above, stability in recording can be improved. However, in such recovery processing which discharges ink in the ink receiver, the printing should be interrupted, and it is a problem from a viewpoint of printing throughput.

On the other hand, as for the preliminary on-paper ejection which performs the preliminary ejection onto paper while printing, it is not necessary to interrupt printing, and thus there is an advantage in improving the throughput. It is not a problem to eject ink into the ink receiver simultaneously, but if the line head performs the preliminary ejection all at once onto paper, a linear image is formed, causing an unfavorable result.

In the preliminary on-paper ejection, in order to suppress thickening of ink which is caused by the recording head being exposed in the air, the ink is ejected definitely from all the nozzles each time a predetermined period of time lapses. This predetermined period is referred to as an allowable exposure time. The allowable exposure time is subject to change by a property of ink, temperature/humidity of ambient environment, a structure of the head, or the like. Therefore, in each of the individual apparatus models, the allowable exposure time to be employed is the shortest one among the above mentioned various time lengths. It is a matter of course that not only the allowable exposure time to be employed but also a cycle of the preliminary on-paper ejection may be changed according to conditions.

If the line head performs the preliminary ejection from all the nozzles simultaneously, a linearly discharged image may be formed on the paper. In order to handle this problem, each nozzle is designed to eject ink randomly within a constant period of time.

Figure 3:
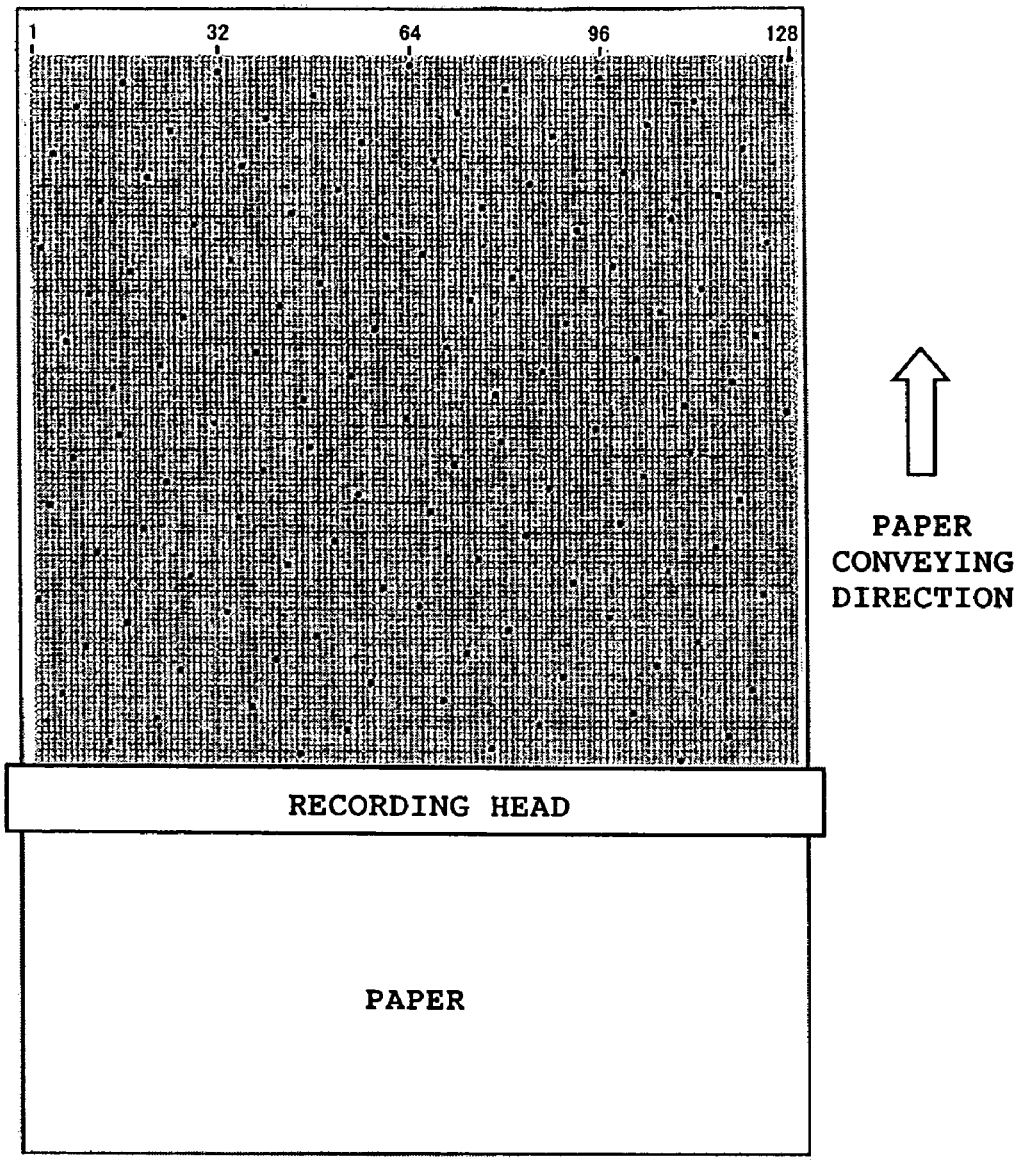
FIG. 3 is an illustration showing a state of recording in the case where a line type recording head having a plurality of nozzles performs only a preliminary on-paper ejection, onto a sheet of paper.

FIG. 3 is an illustration showing a state of recording in the case where a line type recording head having a plurality of nozzles performs only a preliminary on-paper ejection onto a sheet of paper. For the sake of convenience in illustrating, in the examples as shown in FIG. 3 and FIG. 4 to FIG. 7, a single recording head is illustrated, having nozzles the number of which is assumed as 128. In the preliminary on-paper ejection in the example of FIG. 3, it is assumed that one ejection is performed from one nozzle out of 128 nozzles for one line. In the figure, "●" represents data discharged by the preliminary ejection. In order to perform the ejection from all the nozzles, 128 lines are necessary. The time required to complete once the preliminary ejections from all of the nozzles is referred to as "preliminary on-paper ejection cycle". In the example of FIG. 3, the time while printing of 128 lines is performed is assumed as the preliminary on-paper ejection cycle. As can be seen from FIG. 3, since dots recorded by the preliminarily ejection are dispersed on the paper, and also one dot is quite small, they are hardly visible.

The preliminary on-paper ejection cycle in the example of FIG. 3 is equal to the time required for recording 128 lines, and in general, it is sufficiently shorter than the allowable exposure time. Therefore, if the preliminary ejection is not performed from one nozzle for one line, but performed from one nozzle for multiple lines, the preliminary on-paper ejection cycle can be elongated.

Figure 4:
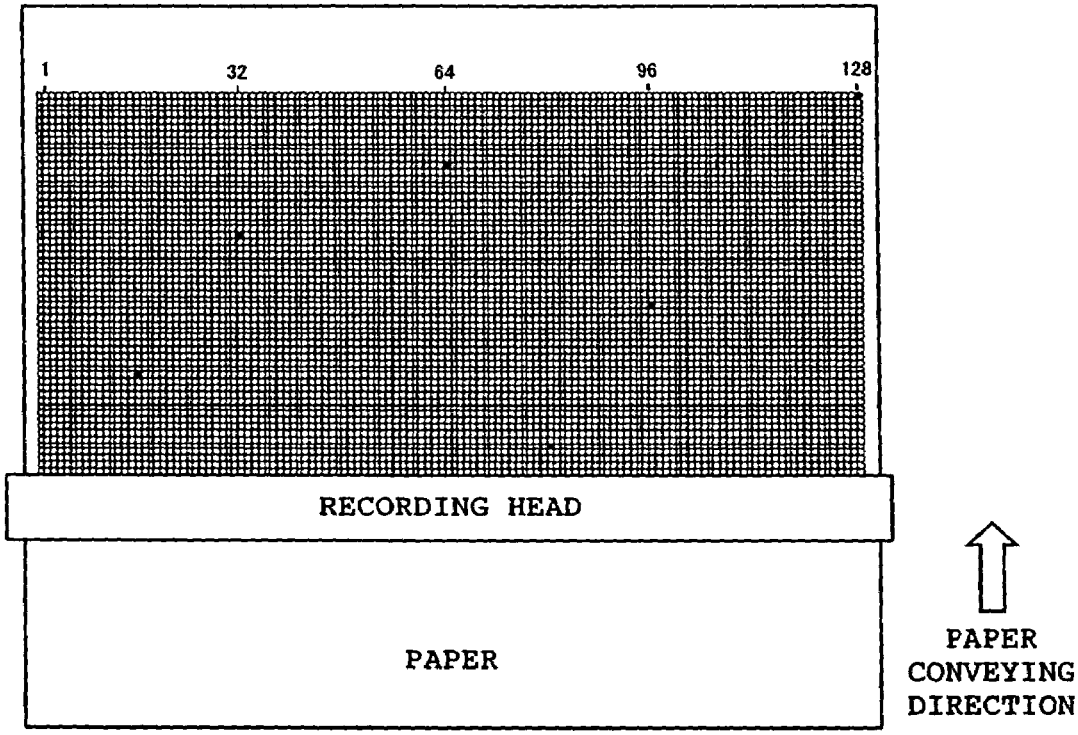
FIG. 4 is an illustration showing a state of a recording in the case where the preliminary on-paper ejection is performed from one nozzle for every 11 lines (at intervals of 10 lines).

In the example of FIG. 4, the preliminary on-paper ejection is performed with a time interval, from one nozzle for every 11 lines (at intervals of 10 lines). If the interval of the preliminary on-paper ejections is made longer, the result of the ejection becomes more inconspicuous. However, the preliminary on-paper ejection cycle becomes longer by that much. If this cycle is too long, a situation may occur where the preliminary ejection from some nozzles will not be carried out at all, even after the lapse of the time longer than the allowable exposure time.

A required interval between the preliminary on-paper ejections may be changed by parameters such as a recording head of the ink jet recording apparatus, ink, print speed, and temperature/humidity. If the interval is made shorter than needed, for example, preliminary ejections are performed from multiple nozzles for one line, the preliminary on-paper ejection may adversely affect the image quality. Therefore, the preliminary on-paper ejection cycle is required to be set so that both the image quality and the intended purpose of the preliminary ejection are satisfied. It is also possible to variably control the preliminary on-paper ejection cycle, so that it can be set as an acceptable maximum cycle according to conditions.

As to a nozzle which is not excluded from the preliminary ejection target, the preliminary ejection is performed at least once onto paper at a predetermined point of time within the preliminary ejection cycle, and this predetermined point of time is differentiated with respect to each of the nozzles of a recording head. These variable points of time are referred to as a preliminary on-paper ejection pattern. This preliminary on-paper ejection pattern is stored in the memory prior to printing, and when the printing is started, the pattern is read in parallel with the image data, and transferred to each recording head. Alternatively, a hardware circuit and/or software processing may be employed, which generate a random preliminary on-paper ejection pattern within the printer.

Here, a problem which may occur will be explained with reference to FIG. 5, in the case where the preliminary on-paper ejections as shown in FIG. 3 or FIG. 4 are continuously performed while printing.

Figure 5:
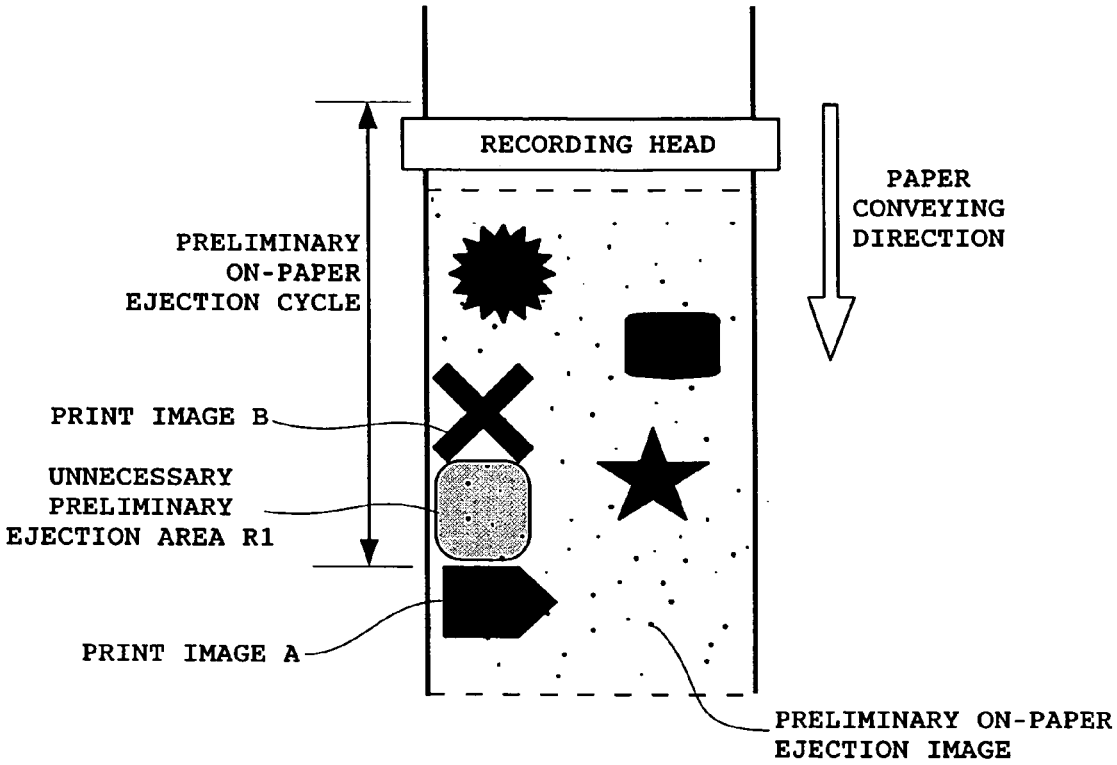
FIG. 5 is an illustration to explain a problem in the case where the preliminary ejections as showing in FIG. 3 or FIG. 4 are continuously performed while printing.

As shown in FIG. 5, it is assumed here as an example that print images A, B, and the like, are outputted while the paper is transferred into the conveying direction as indicated in the figure. It is also assumed that the nozzle used for recording the print images A and B are the same. (In such a case as described above, each of the nozzles required for recording the print image A is only required to eject only once during the preliminary on-paper ejection cycle as is shown, but redundant recording is performed for the print image B.) As for a group of the nozzles in charge of recording the print image B performs extra preliminary ejection onto an area such as preliminary on-paper ejection area R1, even though such preliminary ejection is not needed. It occurs because the preliminary on-paper ejection data is combined with the image data, without considering the image as a print target.

Figure 6:
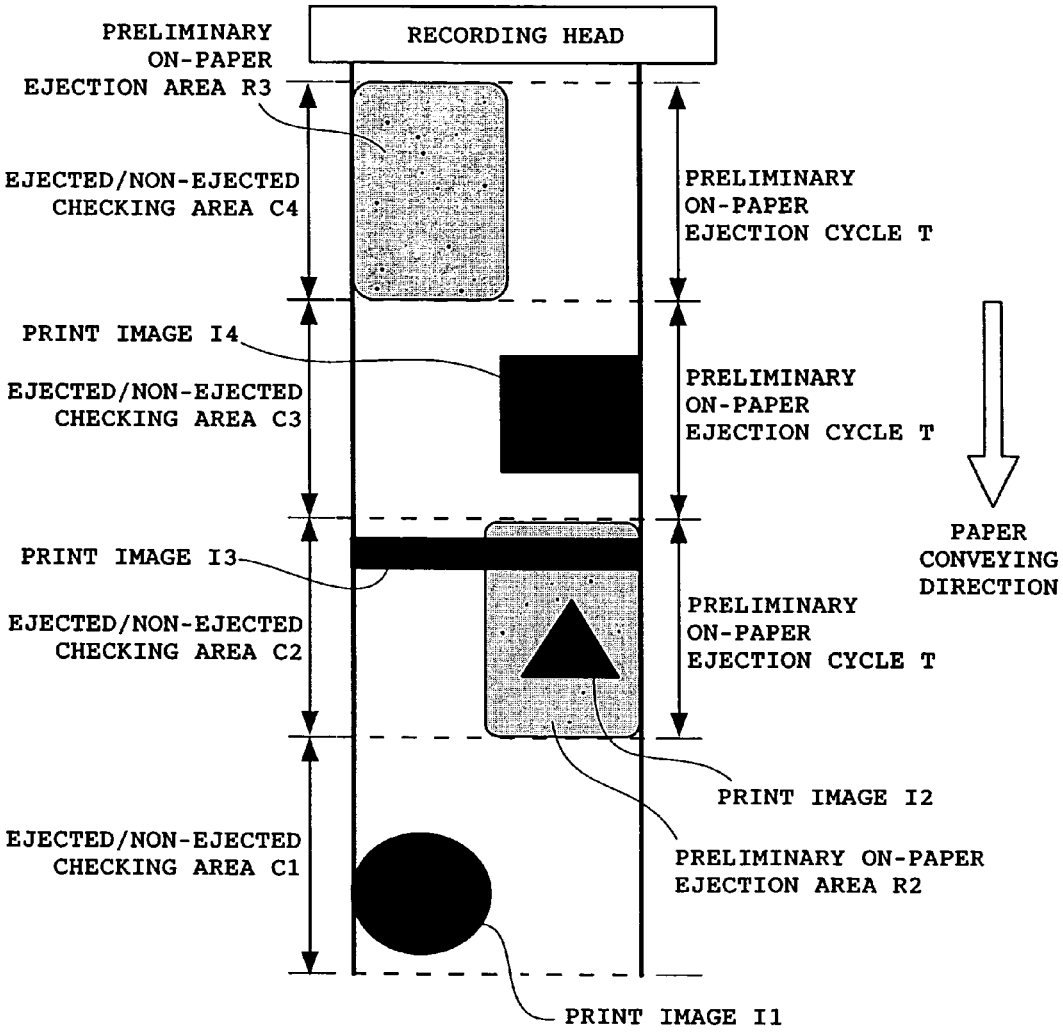
FIG. 6 is an illustration to explain a preliminary on-paper ejecting method which is to reduce unnecessary preliminary on-paper ejection according to the embodiment of the present invention.

The present invention intends to reduce this unnecessary preliminary on-paper ejection in the case where such images as described above are printed. With reference to FIG. 6, a method for achieving the above object will be explained.

It is assumed that while the paper is transferred in the conveying direction as shown in FIG. 6, by way of example, print images such as print image I1, print image I2, print image I3, and print image I4 are outputted. In the present embodiment, a print area corresponding to the preliminary on-paper ejection cycle T is defined as "ejected/non-ejected checking area". In each of the ejected/non-ejected checking area, it is checked whether or not at least one time ejection has been performed with respect to each of the nozzles of the recording head (line head) during the preliminary on-paper ejection cycle T, and the result of checking is held as a variable referred to as "ejected/non-ejected checking bit" which is used to record the ejection history for each nozzle. In this particular example, value "0" of the ejected/non-ejected checking bit corresponds to "ejected", and "1" corresponds to "non-ejected". In the example of FIG. 6, the ejected/non-ejected checking bit for the group of nozzles in charge of recording the print image I1 becomes "0" in the ejected/non-ejected checking area C1. As thus described, if a nozzle performs the ejection at least once, execution of the preliminary on-paper ejection from this nozzle is omitted in the subsequent preliminary on-paper ejection cycle T. In other words, in the ejected/non-ejected checking area C2, the group of nozzles in charge of recording the print image I1 does not perform preliminary ejection at all within this area C2. As for the remaining preliminary on-paper ejection area R2, the preliminary ejection is performed one time from each nozzle. Also in the ejected/non-ejected checking area C2, including the area for which the execution of preliminary on-paper ejection has been omitted, it is checked as to each nozzle whether or not the ejection has been performed, and a value is set in the ejected/non-ejected checking bit. In the ejected/non-ejected checking area C2, the print image I3 which goes across the total width of the paper is recorded, and thus, the ejected/non-ejected checking bits of all the nozzles are set to "0". Therefore, in the entire ejected/non-ejected checking area C3 corresponding to the subsequent preliminary on-paper ejection cycle T, the preliminary on-paper ejection is omitted. Since the print image I4 exists in this ejected/non-ejected checking area C3, the ejected/non-ejected checking bits of the group of nozzles in charge of printing the image I4 are set to "0", and the preliminary on-paper ejection from this group of nozzles in the ejected/non-ejected checking area C4 corresponding to the subsequent preliminary on-paper ejection cycle T is omitted. As for the nozzles other than the above group of the nozzles, one time preliminary ejection is performed from each of the nozzles in the preliminary on-paper ejection area R3.

In such a manner as described above, according to the preliminary on-paper ejecting method of the present invention, an unnecessary preliminary on-paper ejection can be omitted, while a requirement for performing the preliminary ejection from all the nozzles are satisfied.

Figure 7:
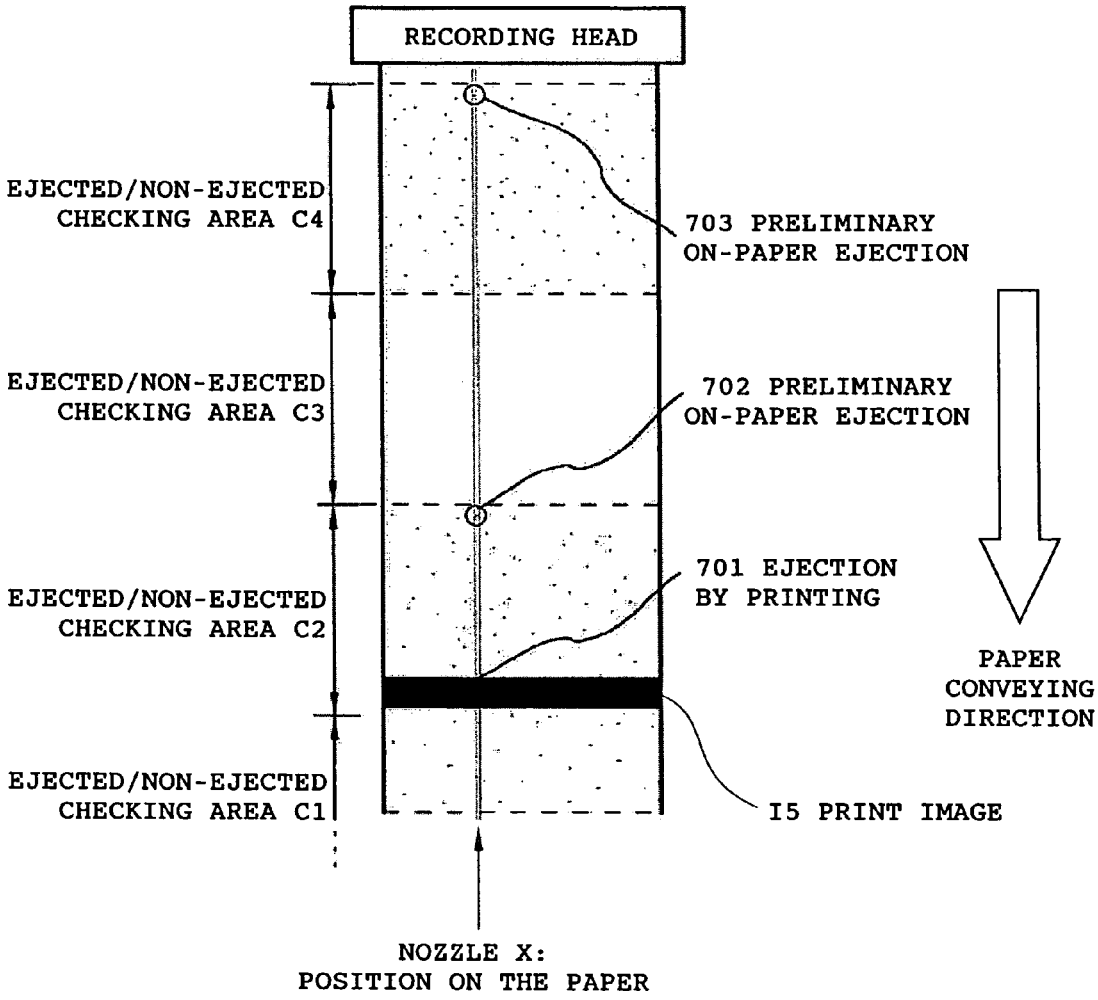
FIG. 7 is an illustration to explain a problem in the case where an image data nearly blank form is printed, having a few pixels to be recorded.

A point to be noted in the preliminary on-paper ejecting method as explained with FIG. 6 is that even though the preliminary ejection within one preliminary on-paper ejecting cycle T is omitted, the non-ejected period must not exceed the allowable exposure time. Accordingly, consideration of only the preliminary on-paper ejection cycle T in which the preliminary on-paper ejection is omitted is not sufficient, and it is necessary to consider a continuous non-ejected period existing in the previous and the subsequent preliminary on-paper ejection cycles T. As shown in FIG. 7, a situation is taken as an example where image data indicating nearly blank form, with just a few recording pixels, is printed. In the example shown in FIG. 7, only the print image I5 is recorded, which extends laterally at the top side (lower side in the figure) of the ejected/non-ejected checking area C2. In this case, in the subsequent ejected/non-ejected checking area C3, since the preliminary on-paper ejection is omitted and further there exists no image, the ejection is not performed at all as to all the nozzles. In the subsequent ejected/non-ejected checking area C4, the preliminary on-paper ejection is performed across the total width. Here, it is to be noted that ejection timing is different by each nozzle. In such a case, as for the nozzle X in the example of FIG. 7, non-ejected period corresponding to two cycles of the preliminary on-paper ejection cycle T occurs, from the preliminary on-paper ejection 702 to the preliminary on-paper ejection 703. This situation above usually occurs in a condition that the preliminary on-paper ejection patterns in the respective preliminary on-paper ejection cycles C2 and C4 are completely the same. Furthermore, as for the nozzle X, if the preliminary on-paper ejection pattern is a random pattern, there is a possibility that the non-ejected period may become the longest. That is, the preliminary on-paper ejection occurs at the top of the ejected/non-ejected checking area C2, and the preliminary on-paper ejection may occur at the rear end of the ejected/non-ejected checking area C4, with placing cycle C3 therebetween. This non-ejected period corresponds to approximately three cycles of the preliminary on-paper ejection cycle T. It is necessary that the non-ejected period does not exceed the allowable exposure time in such a worst case. Therefore, in order to satisfy the condition above, three cycles of the preliminary on-paper ejection cycle T should fall within the allowable exposure time. Consequently, the preliminary on-paper ejecting cycle corresponding to each ejected/non-ejected checking area should be equal to or less than one third of the allowable exposure time.

Any particular timer means is not necessary to determine the non-ejected period for each nozzle of line head, and it is determined by the number of consecutive lines with no ejections performed, and an already known paper conveying time per line. Therefore, even when the recording speed is changed, the non-ejected period can be calculated based on the number of non-ejected lines. In the present embodiment, it is only determined whether or not the ejection has been performed within the preliminary on-paper ejection cycle (one-time ejection and more than once ejection are not discriminated, and both just defined as "ejected"). Therefore, it is not necessary to count the number of non-ejected lines, and as far as there exists one bit with respect to each nozzle (that is, "ejected/non-ejected checking bit"), it is possible to store whether or not the ejection has been performed. Therefore, it is not necessary to provide a counter for each nozzle, and preparing a memory capacity for one bit with respect to each nozzle is sufficient. It is to be noted here that for the sake of smooth controlling in the present embodiment, one more bit ("preliminary on-paper valid bit") is employed with respect to each nozzle, so as to hold a value of the ejected/non-ejected checking bit.

Figure 8:
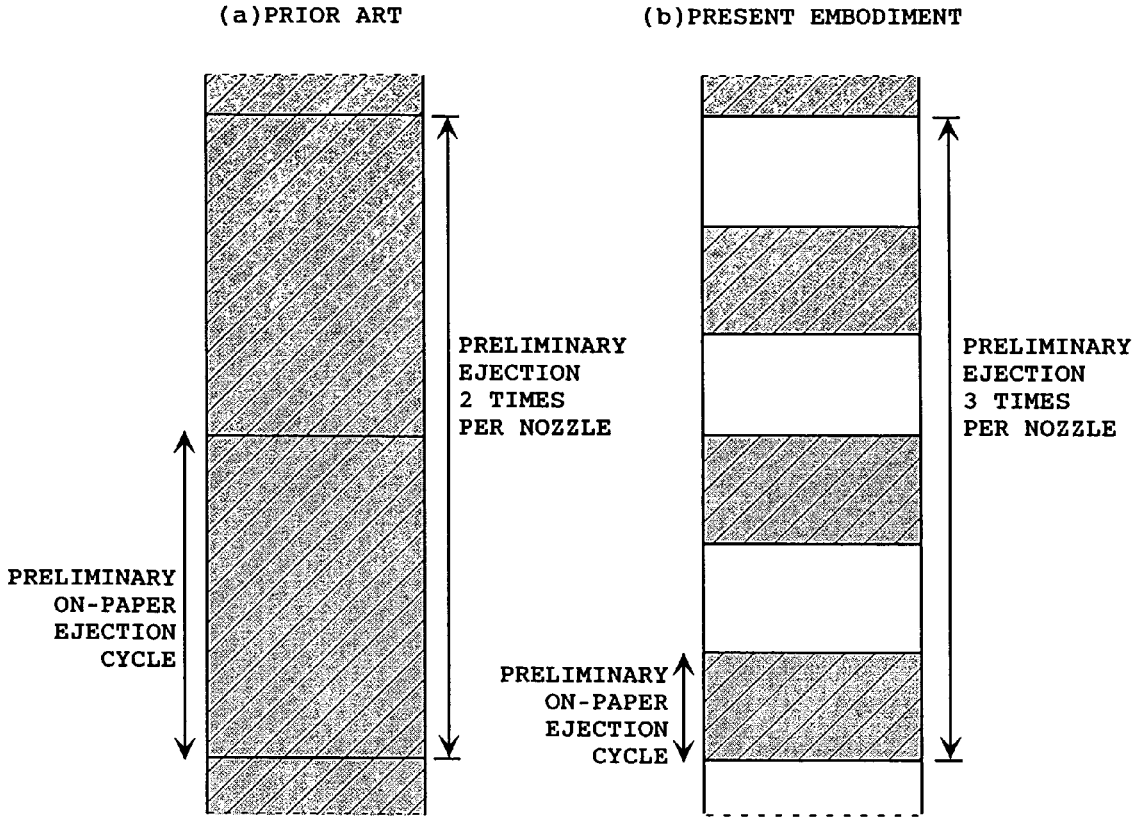
FIG. 8A and FIG. 8B are illustrations which compare a conventional preliminary on-paper ejection not considering image data, with the preliminary on-paper ejection according to an embodiment of the present invention.

FIG. 8A and FIG. 8B are illustrations so as to compare a conventional preliminary on-paper ejection without considering image data (FIG. 8A), with the preliminary on-paper ejection according to the embodiment of the present invention (FIG. 8B). For practical purposes, this example represents that the printing result is a complete blank form, even though it does not seem to end in such result in reality. In FIG. 8A and FIG. 8B, portions filled with gray color and being hatched indicate areas onto which the preliminary on-paper ejection is performed. As can be seen from the figures, the preliminary on-paper ejection cycle according to the present embodiment is reduced to one third of the conventional one, and as a result, the preliminary on-paper ejection per nozzle is 1.5 times more frequent than the conventional example. Therefore, if an image nearly blank form is printed with the preliminary on-paper ejecting method which renders the preliminary on-paper ejection cycle equal to or less than one third of the allowable exposure time, it may rather increase the number of preliminary ejecting counts. It is to be noted here that the conventional preliminary on-paper ejection cycle is around 1 to 10 seconds. For instance, if the recording speed is 1 m per second, the length printed by the preliminary on-paper ejection cycle is 1 m to 10 m. The length of printing by the preliminary on-paper ejection cycle, which is one third of the conventional one, is approximately 33 cm to 3.3 m. In this case, however, the preliminary ejection is dispersed into a wide range, and the quite small dots of the ejected ink by the preliminary on-paper ejection are almost invisible. If a general image is printed, a large amount of image data is included in printing. Therefore, it is expected that the number of nozzles which are required to perform the preliminary on-paper ejection is drastically reduced.

As in the case that the preliminary on-paper ejection patterns are completely the same in each of the ejected/non-ejected checking areas, if the maximum non-ejected period is limited to two cycles of the preliminary on-paper ejection cycle T at most, it is not necessary to render the preliminary on-paper ejection cycle to be equal to or less than one third of the allowable exposure time. Being equal to or less than one half thereof is sufficient. In the case above, the frequency of the preliminary on-paper ejection per nozzle becomes the same as the frequency in the conventional art.

Figure 9:
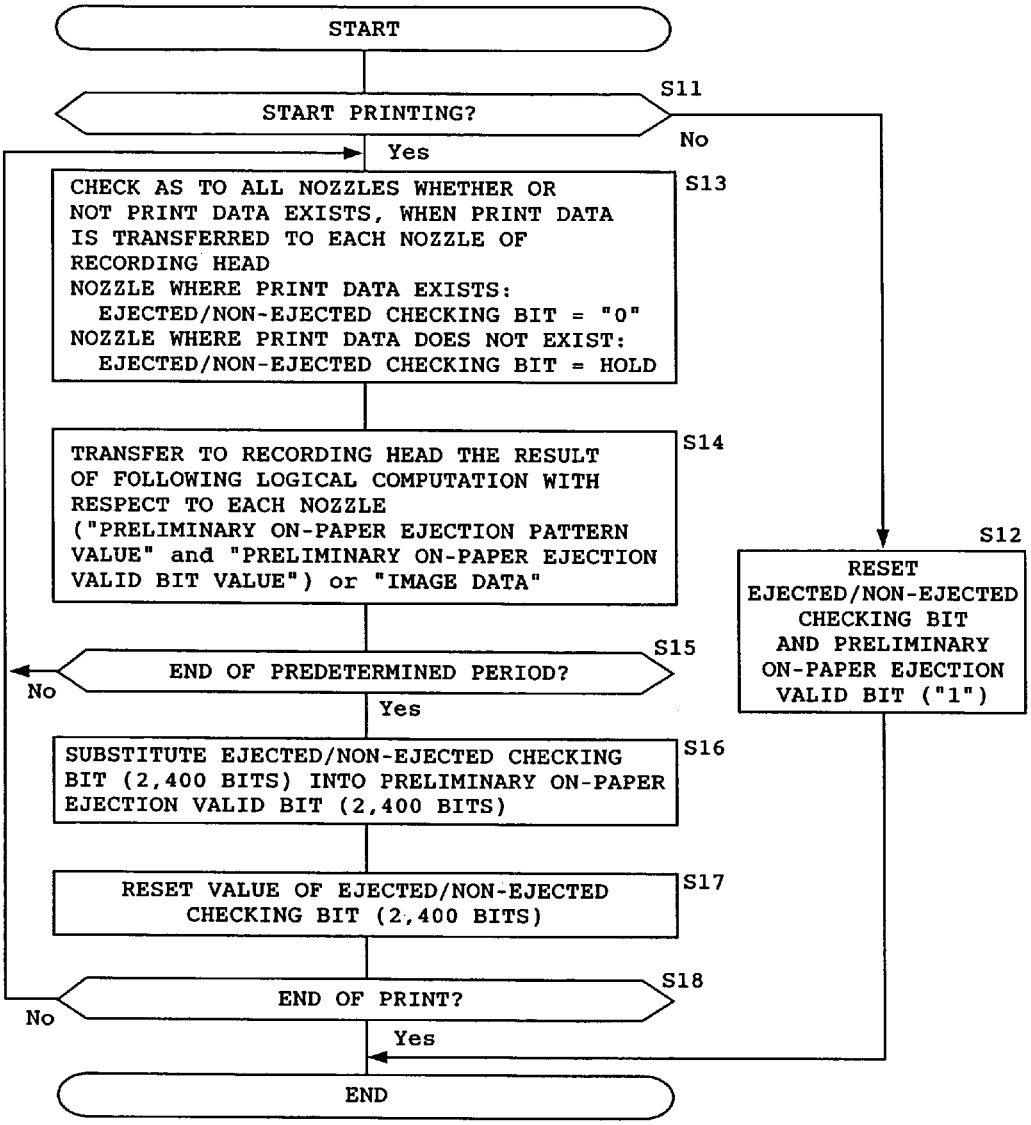
FIG. 9 is a flowchart showing a detailed control method of the preliminary on-paper ejection according to the embodiment of the present invention.

Hereinafter, with reference to the flowchart as shown in FIG. 9, a detailed control method of the preliminary on-paper ejection according to the present embodiment will be explained. This processing is implemented when the CPU of the main controller 201 as described above reads and executes control programs stored in the program memory 202. Processing indicated by another flowchart described below is also implemented in the same manner. This processing is executed with respect to each recording head.

In a state where printing has not been started yet (S11), values of the "ejected/non-ejected checking bit" and "preliminary on-paper ejection valid bit" (valid flag) as parameters for the preliminary on-paper ejection are reset (to "1") (S12). The preliminary on-paper ejection valid bit is a variable which determines whether or not the preliminary ejection according to the preliminary on-paper ejection pattern with respect to each nozzle is made effective in each preliminary onto-paper ejection cycle. A value of the ejected/non-ejected checking bit, having been checked in a cycle of the preliminary on-paper ejection cycle is periodically substituted into the preliminary on-paper ejection valid bit associated with that value, prior to resetting the ejected/non-ejected checking bit for the subsequent cycle.

This particular example assumes a case where the number of nozzles of each recording head on the line head is 2,400. That is, the number of the ejected/non-ejected checking bit and the number of the valid bit are both 2,400 bits. In other words, if plural recording heads are mounted, the ejected/non-ejected checking bits are provided respectively.

When printing is started (S11, Yes), it is recorded in the aforementioned ejected/non-ejected checking bit whether or not print data exists with respect to each nozzle, the print data being to be transferred to each recording head (S13). This print data, to which the preliminary on-paper ejection data is also added, is data based on which ink is actually discharged from the recording head. When the value of this print data indicates existing, "0" is substituted as a value of the ejected/non-ejected checking bit of an associated nozzle, so as to record a history of ejections. If neither the image data nor the preliminary ejection data exists, substitution is not made and the previous value is held.

Next, when the aforementioned print data to be transferred to each recording head is generated, print data to be sequentially transferred to each nozzle is generated according to the following condition (logical expression) (S14).

<"Preliminary on-Paper Ejection Pattern Value" and "Valid Bit" or "Image Data">

Here, "and" and "or" represents AND operation and OR operation respectively. According to this formula, the aforementioned print data to be transferred to each recording head is generated based on the valid flag. That is, the valid flag held for the nozzle which is determined as not ejected is set to indicate the preliminary on-paper ejection as "effective". And only when the valid flag is "effective", the preliminary on-paper ejection pattern is added to the image data to generate the print data.

When the preliminary on-paper ejection pattern value is "1", i.e., the preliminary on-paper ejection data exists and the preliminary on-paper ejection valid bit value is "1", i.e., ejection of print data was not performed just before, the preliminary ejection data is added regardless of the presence or absence of the image data, and the print data is set to "1". When the preliminary on-paper ejection valid bit value is "0", the preliminary ejection data is not added even though the preliminary ejection pattern value is "1". It is a matter of course that if the image data is "1" it is transferred to the recording head as it is.

After the transfer of the print data is carried out for a predetermined period of time (S15), that is, at the end of the preliminary on-paper ejection cycle, the values of all the ejected/non-ejected checking bits are substituted into the preliminary on-paper ejection valid bits (S16), and the values of the ejected/non-ejected checking bits are all reset to "1" (S17). The above operations are repeatedly executed until the printing is completed (S18). With the processing as described above, it is possible to reduce unnecessary preliminary on-paper ejection.

In the embodiment of the present invention as described above, it is configured such that the preliminary on-paper ejection process as explained in FIG. 9 is always performed while printing. However, it is possible to receive from the host computer, information such as the number of print pixels simultaneously with the image data, so as to be aware of a ratio of the image data to the overall image size, and the configuration can be changed so that a conventional preliminary on-paper ejection is performed, if the print job has just a small number of pixels as a whole.

Figure 10:
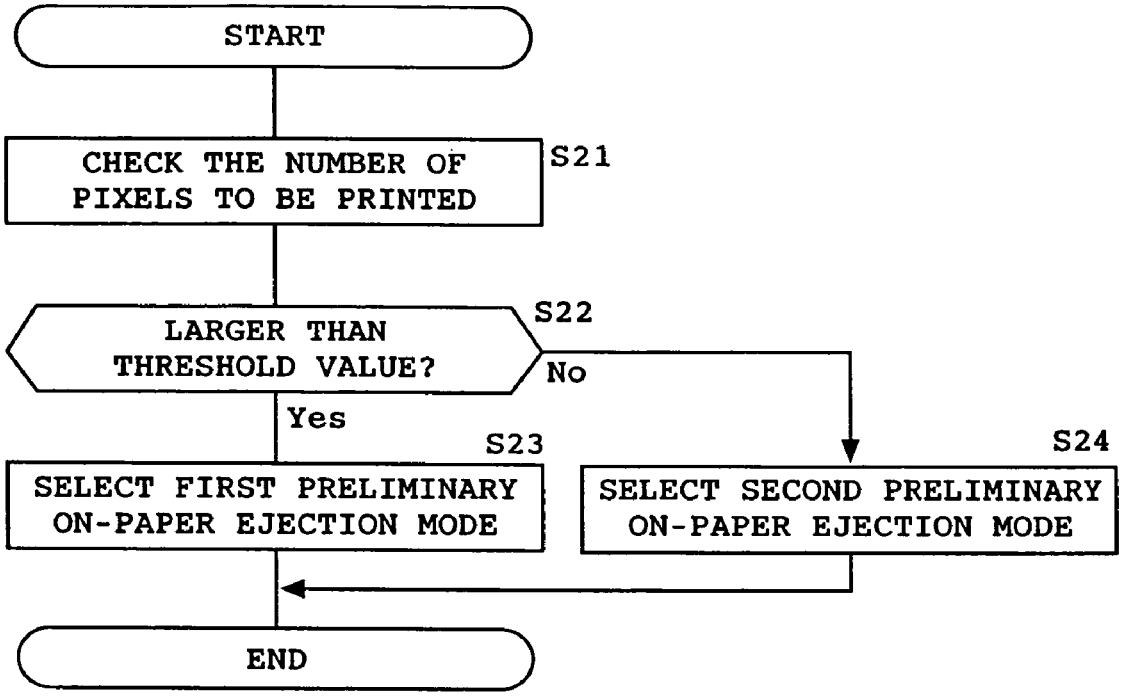
FIG. 10 is a flowchart showing an operation according to the second embodiment of the present invention.

FIG. 10 is a flowchart showing an operation of the second embodiment of the present invention, which employs the above control. The constituent elements of the second embodiment are the same as those of the first embodiment, and tedious explanations shall not be given. In the present embodiment, as an operational mode of the preliminary on-paper ejection, there are prepared a first preliminary on-paper ejection mode and a second preliminary on-paper ejection mode. The first preliminary on-paper ejection mode determines every predetermined period of time whether or not the preliminary on-paper ejection is necessary based on a detected result whether the ejection has been performed or not with respect to each nozzle. The second preliminary on-paper ejection constantly performs on-paper ejection while printing, regardless of the detected result whether the ejection has been performed or not. The first preliminary on-paper ejection mode is an operation mode which omits execution of the preliminary on-paper ejection according to the image data, with respect to each nozzle as shown in FIG. 9. The second preliminary on-paper ejection mode is an operation mode which constantly executes the preliminary on-paper ejection as shown in FIG. 3 and FIG. 4.

In the process as shown in FIG. 10, firstly, the number of print pixels is checked with respect to each recording head (S21), thereby determining whether or not the print result is nearly blank form (S22). When the number of print pixels is more than a predetermined threshold value, the first preliminary on-paper ejection mode is selected (S23). When the number of print pixels is equal to or less than the predetermined threshold value, the second preliminary on-paper ejection mode is selected (S24).

With the control thus described above, it is possible to select and execute more appropriate preliminary on-paper ejection operation according to the print job. It is determined whether or not the print result is nearly blank form by checking the number of print pixels, but it is not limited to this. In addition, the preliminary ejection from one nozzle in one preliminary on-paper ejection cycle is set to one time, but it is not necessarily limited to one time, and plural times may also be applicable.

According to the present embodiment, printing is not interrupted by the head recovery processing, and it is possible to provide an ink jet recording apparatus in which the preliminary on-paper ejection can be executed more effectively than conventional apparatus. It is also possible to switch the preliminary on-paper ejection method according to the print image data, thereby providing an ink jet recording apparatus in which the preliminary on-paper ejection has little effect on an actual printed image.

Next, the ink jet recording apparatus relating to the second embodiment of the present invention will be explained. This ink jet recording apparatus employs, in particular, a recording head in which ink discharge openings are arranged in the width direction of the recording medium. It is preferable to apply this apparatus to a mode of recording on a recording medium such as cardboard and envelope, having a flap portion, an overlap width (laminated portion) and the like.

As described above, particularly in a field of industrial use recording, a need for both recording stability and high recording speed is severe. In other words, in order to achieve a stable recording, performance maintenance operation such as preliminary ejection is required. However, at the same time, it is not preferable the recording is interrupted by such an operation. In addition, relatively large amount of preliminary ejection may cause lowering of adhesive property of a portion to be adhesively processed, and such kind of lowered adhesive property may deteriorate the performance to process the recording medium. Therefore, it is required to restrain such deterioration in performance for processing the recording medium.

Considering the points above, the inventors of the present invention have studied zealously, and have come up with an idea that renders the productivity in recording operation compatible with keeping of processing performance of the recording medium. It can be achieved by carrying out the preliminary ejection whose amount does not go over a predetermined value and which is directed to an appropriate position according to a shape of the recording medium as a recording target.

Figure 11:
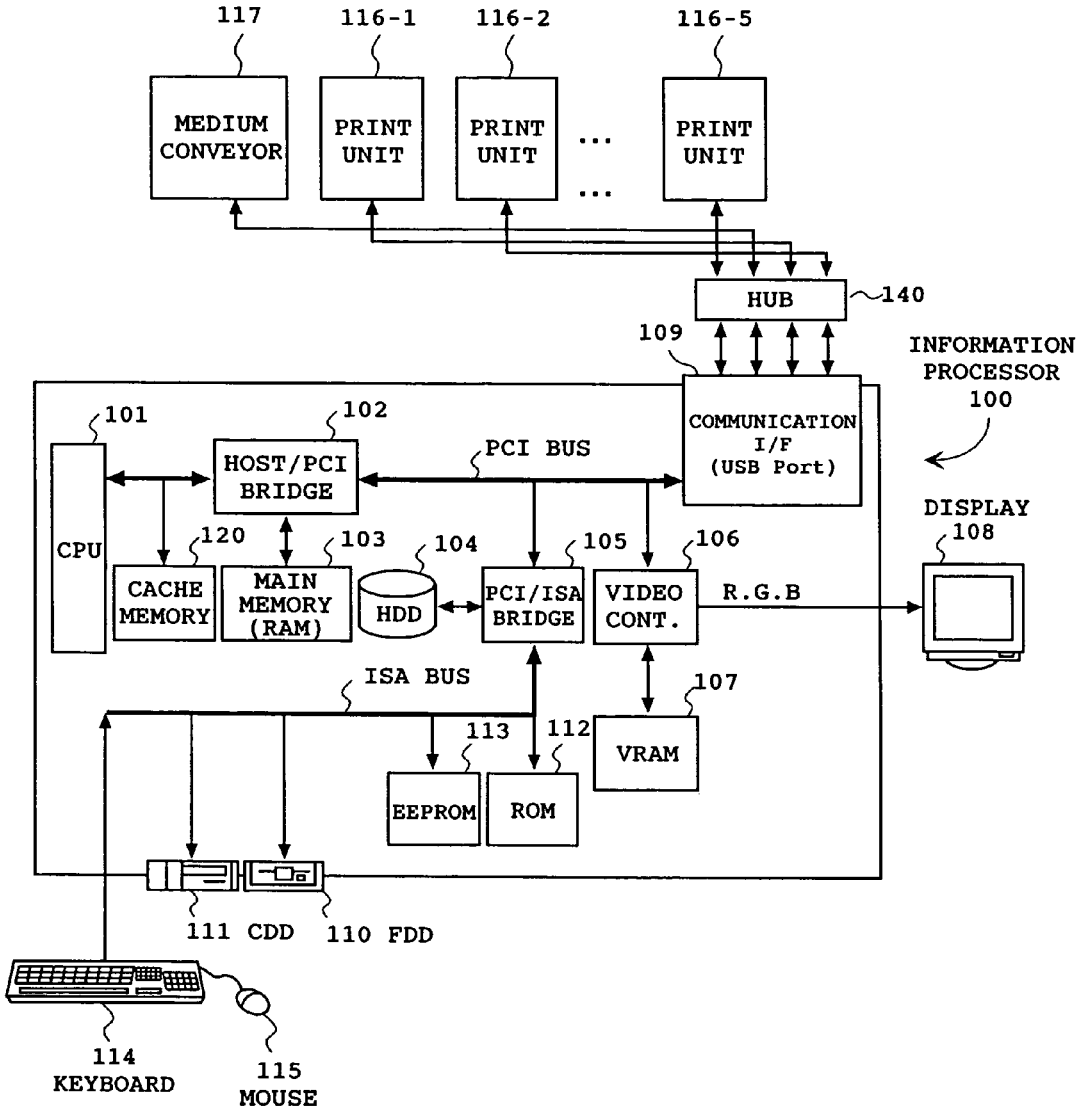
FIG. 11 is a block diagram showing an overview of an image forming system to which the present invention is applicable.
Figure 12:
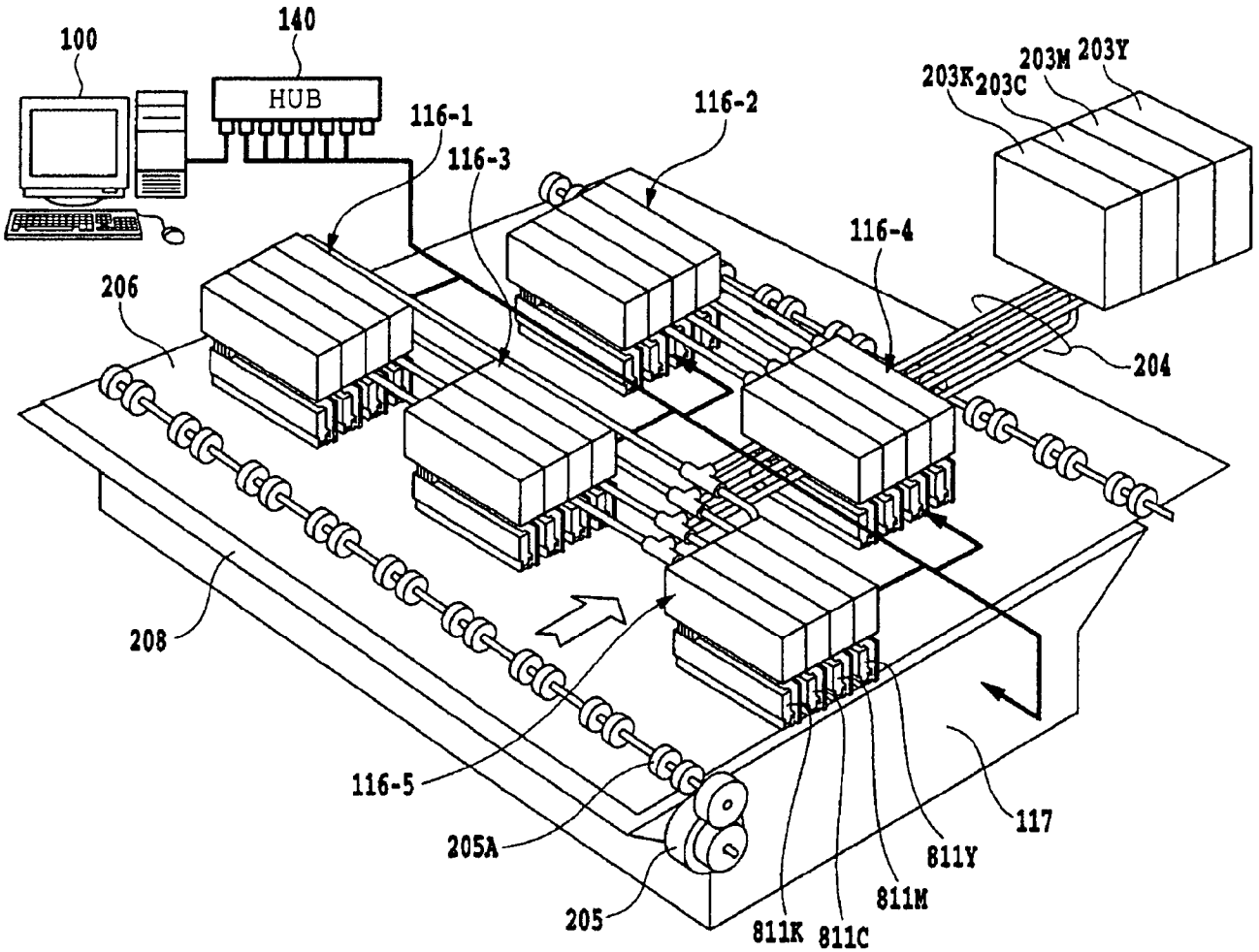
FIG. 12 is a schematic perspective diagram showing the overview of the image forming system to which the present invention is applicable.
Figure 13:
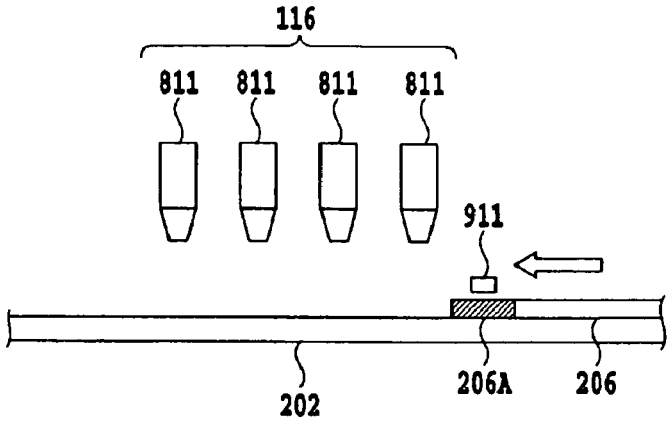
FIG. 13 is a schematic side view of the recording area shown in FIG. 12.

FIG. 11 and FIG. 12 are respectively a block diagram and a schematic perspective diagram, showing an overview of an image forming system relating to the present embodiment. FIG. 13 is a schematic side view of the recording area.

The image forming system according to the present embodiment is generally provided with an information processor 100, medium conveyor 117, a plurality of print units 116-1 to 116-5 (hereinafter, referred to just as reference numeral 116 if not specified).

The information processor 100 is a source to supply image data to be formed and to divide one image into regions, so as to supply image data items respectively associated with positions at which a plurality of print units 116-1 to 116-5 are disposed. The medium conveyor 117 conveys the recording medium 206 having a size in the width direction corresponding to a range recordable according to a layout of the print units 116-1 to 116-5.

As shown in FIG. 13, in order to perform full-color recording onto the recording medium 206, each of the print units is provided with recording heads 811K, 811C, 811M, and 811Y (hereinafter, referred to as reference numeral 811, if not specified), respectively for ejecting black (K) ink, Cyan (C) ink, Magenta (M) ink, and Yellow (Y) ink, from upstream side of the recording medium conveying direction as shown by the arrow in the figure, and each recording head is placed so that the ink ejecting direction from the discharge opening is perpendicular to the surface of the recording medium. Each of the print units has the same alignment sequence of the recording heads along the medium conveying direction, and thus the sequence of overlapping colors is the same too. The ink discharge openings of each recording heads are aligned in the width direction of the recording medium (being orthogonal to the medium conveying direction) with a predetermined density across 4 inches (a reference value, around 100 mm), and thus they satisfy a maximum recording width of around 500 mm as a whole. The recording heads are supplied with ink of corresponding colors respectively from ink tanks 203Y, 203M, 203C, and 203K (FIG. 12) as ink supplying source.

The medium conveyor 117 is also suitable for conveying a recording medium which has a large size in width direction and an arbitrary size in conveying direction. In addition, media stage 202 is provided so that a surface to be recorded of the recording medium 206 is regulated to be flat at the parts opposing to the recording heads 811, which are held by the print units 116. Since an item having various thickness is used as the recording medium, it is also possible to add a means (for example, a vacuum pump) to improve adhesion of the recording medium towards the media stage 202, in order to flatten the surface to be recorded even when the recording medium is thick paper such as cardboard. Conveying motor 205 is a drive source of a line of conveying rollers 205A which is to convey the recording medium adhered on the upper surface of the media stage 202. Sensor 911 is added to the medium conveyor 117, the sensor detecting a recording medium edge (paper edge) and outputting a signal to define a recording start position of each of the print units 116-1 to 116-5.

In FIG. 11, CPU 101 is a central processing unit which integrally controls the overall system.

In the information processor 100, under the control of operating system (OS), the CPU 101 executes processing defined by an application program to generate and edit image data, an image dividing program relating to the present embodiment, and programs associated with control programs (printer drivers) of the plurality of print units 116-1 to 116-5. The information processor 100 manages a flow of the overall control of the system including the recording operations of each of the print units 116, and the CPU 101 also executes a processing defined by the program associated with a processing procedure which will be described with reference to FIG. 14.

System bus of the CPU 101 has a hierarchical bus configuration, and it is connected, for instance, to PCI bus as a local bus, via host/PCI bridge 102 by way of example. In addition, it is connected to ISA bus via PCI/ISA bridge 105, and then further connected to equipment on each bus.

Main memory 103 is RAM (Random Access Memory) on which a temporary storage area is provided for storing the application program and for the above control program. Furthermore, the main memory 103 is also used as a working memory for executing each program. Those programs above are read out from a hard disk drive HDD 104 and loaded, for example. It is to be noted here that the system bus holds a high-speed memory which uses SRAM (Static RAM) called cache memory 120, and codes and data which are constantly accessed by the main CPU 101 are stored in this memory.

ROM (Read Only Memory) 112 stores a program (BIOS: Basic Input Output System) which controls I/O devices such as keyboard 114, mouse 115, CDD 111, and FDD 110, being connected via I/O circuit (not illustrated), initialization program prepared for the time when the power is turned ON, self diagnosis program, and data and the like associated with required programs executed by the CPU 101. EEPROM (Electrically Erasable ROM) 113 is nonvolatile memory to store various parameters used permanently.

The ROM 112 or the EEPROM 113 may store data indicating a type and shape of various recording media which are available as a recording target in the present system, and data indicating a preliminary ejecting position associated with the recording medium. Alternatively, those data items may be stored on a hard disk and the like, and read into the main memory 103 appropriately. Then, in response to the type of the recording medium designated by a user via the I/O device prior to recording, recording is performed following the recording processing procedure as described below.

Video controller 106 reads consecutively and cyclically, RGB display data written in VRAM (Video RAM) 107 and successively transfers thus readout data as an image refresh signal, to display 108 such as CRT, LCD, PDP (Plasma Display Panel).

Communication interface 109 with the print units 116-1 to 116-5 is connected to PCI bus, and as available interfaces, there are connections, for example, by Bidirectional Centronics Interface conforming to IEEE 1284 standard, USB (Universal Serial Bus), and Ethernet (registered trademark). FIG. 11 shows a configuration that hub 140 is connected via the communication interface 109, and further this hub 140 is connected to each of the print units 116-1 to 116-5 and the medium conveyor 117. In the present embodiment, a wired type communication interface 109 is employed, but another communication interface such as wireless LAN may be used.

The information processor 100 is connected with the plurality of print units 116-1 to 116-5 and the medium conveyor 117 via the hub 140, and the information processor carries out transferring print data, an operation start/end command, and the like. The print unit 116 and the medium conveyor 117 are connected via signals, and a signal for detecting the edge of the recording medium 206, a signal for setting a print head position, and a signal for synchronizing the medium conveying speed and print operation on each print unit (ink discharging operation) are transmitted and received.

Figure 14:
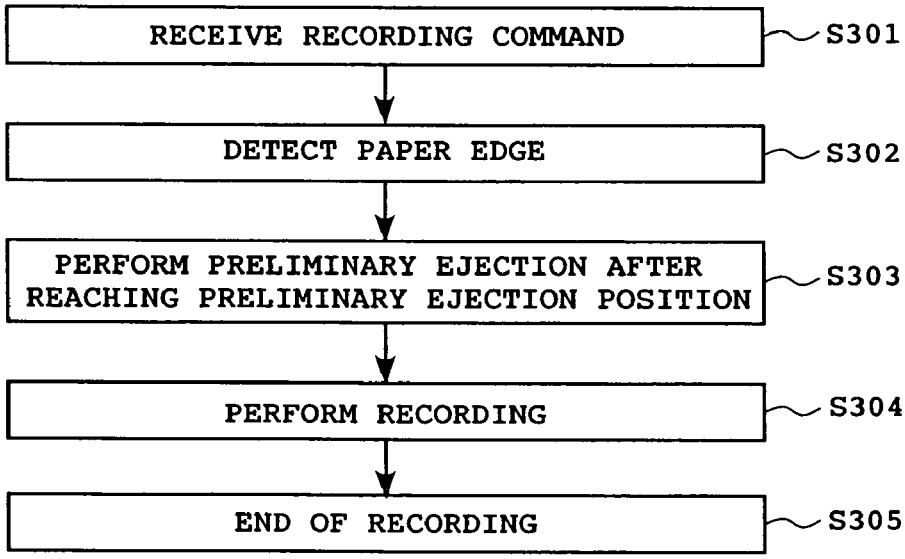
FIG. 14 is a flowchart to explain an overall operational procedure of the image forming system according to the embodiment of the present invention.
Figure 15:
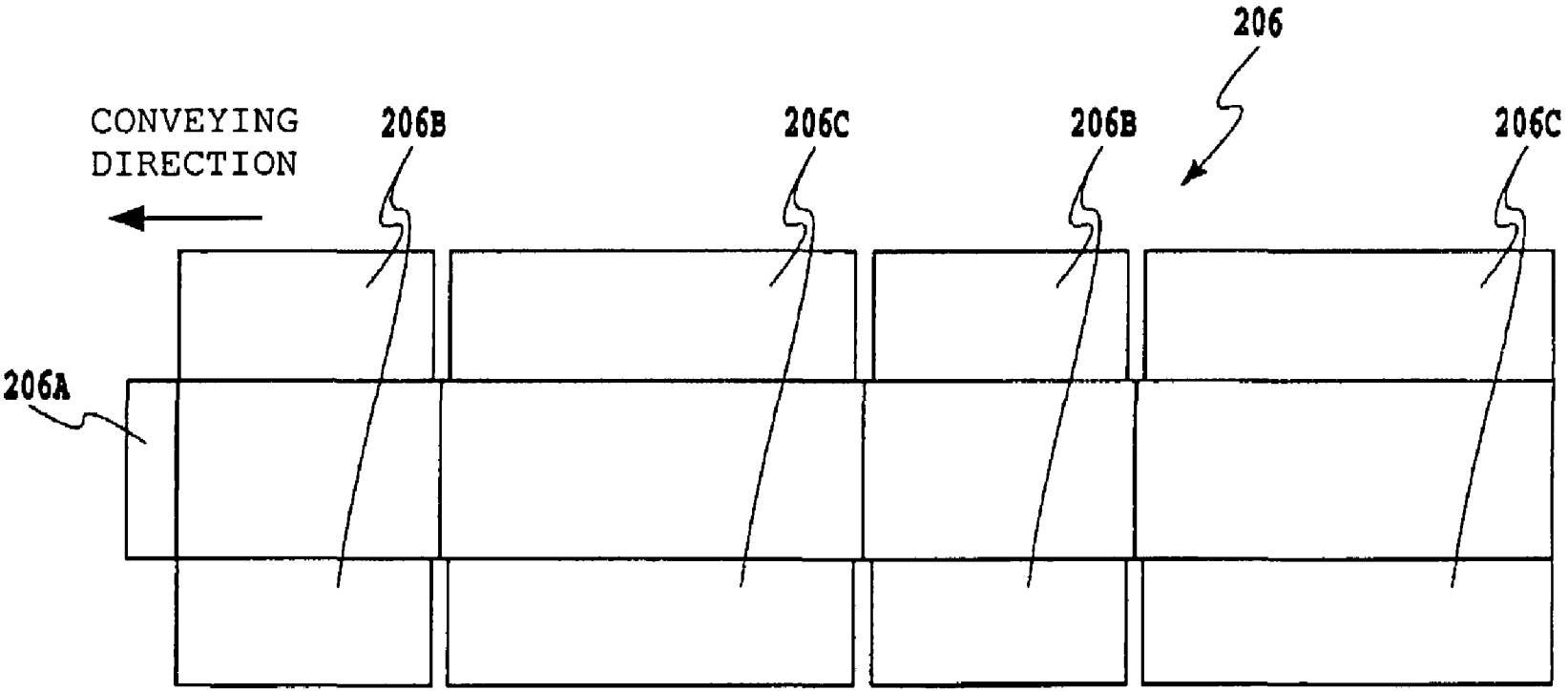
FIG. 15 is a plan view showing a corrugated cardboard as an example of a recording medium which is used as a recording target.
Figure 16:
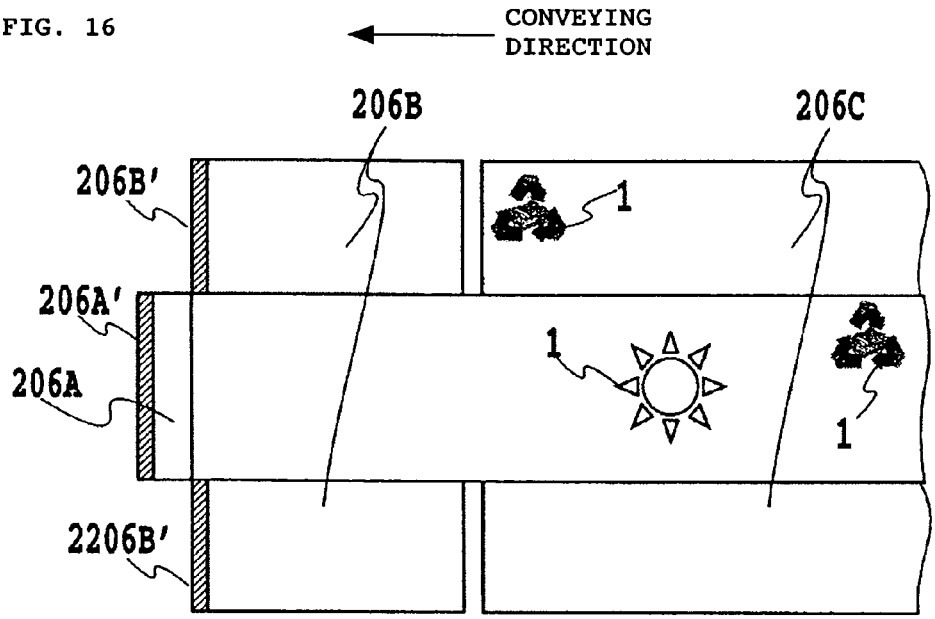
FIG. 16 is an illustration to explain a position of the preliminary ejection on the corrugated cardboard as shown in FIG. 15.
Figure 17:
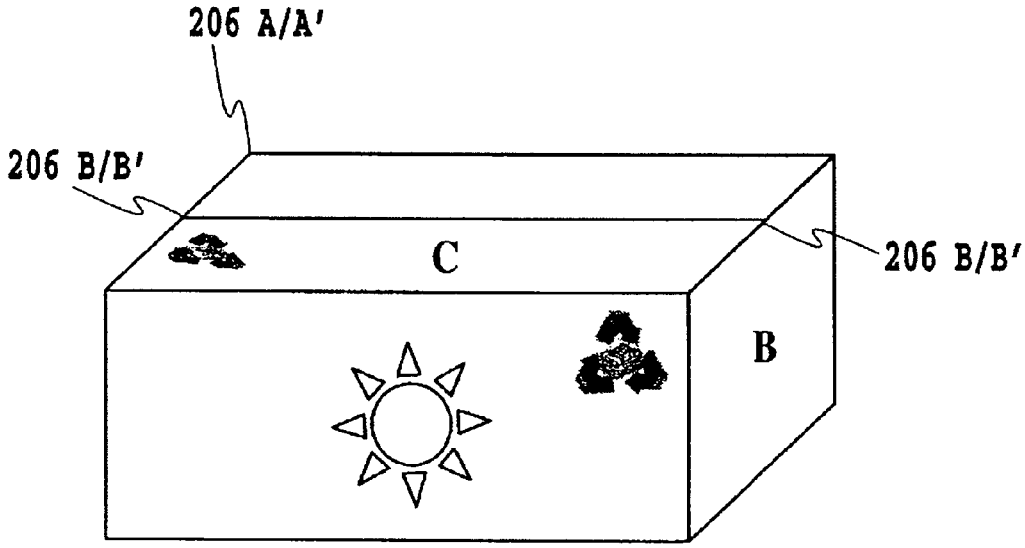
FIG. 17 is a perspective view of a cardboard box, which is processed and formed into a box after the recording.

FIG. 14 is a flowchart to explain an overall operational procedure of the image forming system according to the embodiment of the present invention. FIG. 15 is a plan view showing a corrugated cardboard as an example of a recording medium which is used as a recording target. FIG. 16 is an illustration to explain a position of the preliminary ejection on the corrugated cardboard. FIG. 17 is a perspective view of a cardboard box, which is processed and made into a box after the recording.

In the image forming system, a series of recording operation is started in response to a recording command including a designation of recording medium type and the like (S301), and the medium conveyor 117 starts conveying the recording medium, directing to a position for recording. Here, when the corrugated cardboard as shown in FIG. 15 is used as a recording medium 206 being a recording target, it is conveyed while setting the overlap portion (portion for paste) 206A as a head.

When the sensor 911 (FIG. 12) detects a paper edge (front edge of the overlap portion 206A) of the recording medium (S302), using this paper edge as a reference, the ejection operating point of each print unit 116 can be defined. In other words, if the cardboard paper meets the requirements defined in JIS (Japan Industrial Standard) Z1507, for example, its shape and dimension are recognized in advance. Therefore, it is possible to define the preliminary ejection point and the image forming point in response to the detection of the paper edge. Each of the print units performs the preliminary ejection operation at the preliminary ejection point thus defined (S303), and a predetermined image 1 is recorded by the ink ejection operation at the timing of image forming (S304). After the recording on a recording medium is completed (S305), if another recording operation is carried out for a subsequent recording medium, the processing returns to step S301 and the same procedure is repeated.

As shown in FIG. 16, in the present example, the preliminary ejection is performed onto an area 206A' included in the overlap portion 206A and an area 206B' included in the inner flap 206B, both being parts of the recording medium 206 being a form of cardboard. Here, the overlap portion 206A is a part which is bonded onto inner surface of the rear end side, and the inner flap 206B is a part which is hidden by the outer flap 206C, when the recording medium is formed into a box. Therefore, as shown in FIG. 17, there is no possibility that the preliminary ejection area included in those areas will appear outwardly.

Figure 18:
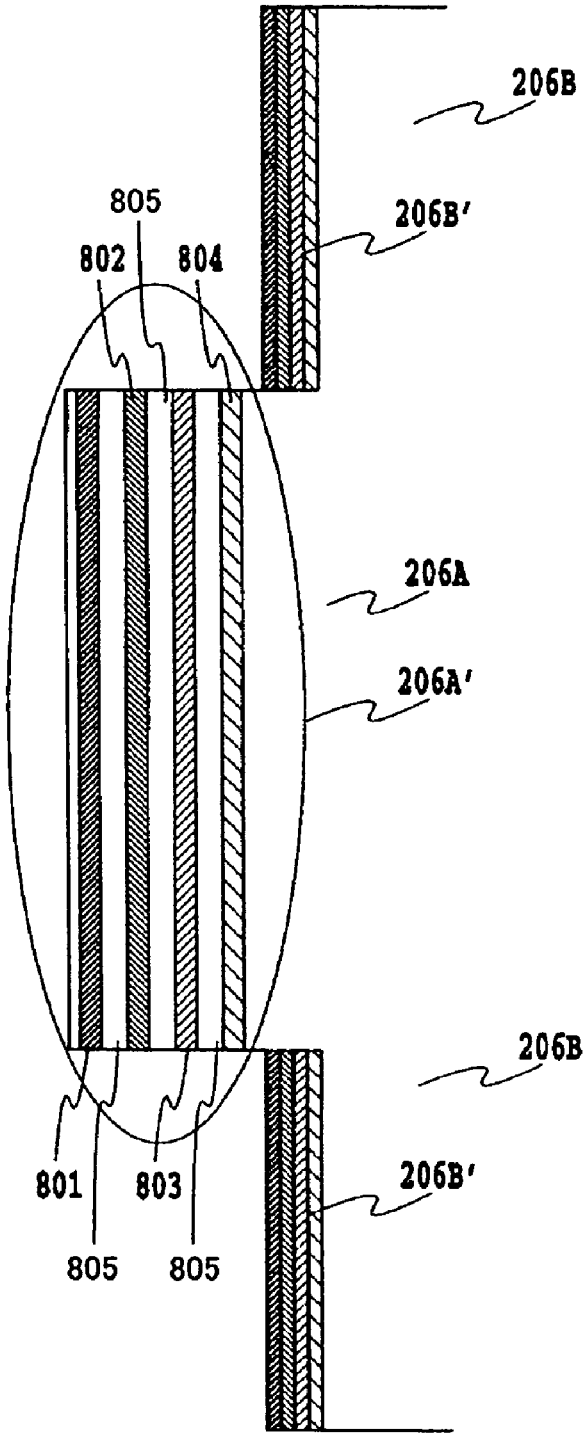
FIG. 18 is a partially expanded view of FIG. 16 showing the preliminary ejection onto an overlap width according to the present invention.

FIG. 18 is an expanded view showing a status of preliminary ejection onto the overlap portion 206A and the inner flap 206B.

It is no problem to perform the preliminary ink ejection onto the preliminary ejection area 206B' which is an ejection target on the inner flap 206B, from each of the recording heads for colors K (Black), C (Cyan), M (Magenta), and Y (Yellow), directing to a relatively narrow region with a recording density of 100% or more, for example.

On the other hand, as for the overlap portion 206A, since it is subjected to a bonding operation in processing, the preliminary ejection of color K (Black) 801, that of color C (Cyan) 802, that of color M (Magenta) 803, and that of color Y (Yellow) 804 are performed in a zigzag pattern for multiple lines (a raster). Generally, since the overlap portion 206A is sufficiently wide compared to one line of the recording head, it is preferable that the preliminary ejection is dispersed as much as possible. In the example of FIG. 18, the preliminary ejection areas corresponding to multiple colors are dispersed. Specifically, multiple lines for each color constitute band-like regions, spaces 805 are provided respectively between the band-like regions of the preliminary ejections 801 and 802, 802 and 803, and 803 and 804.

For example, a recording medium to which the present invention can be effectively applied includes a cardboard paper defined in the aforementioned JIS Z1507 and an envelope paper defined in JIS S5502. These recording media as described above are provided with a flap portion and an overlap width, as hidden parts, after it is made into a box or a pack. However, the recording medium is not limited to the above examples, and any other type of item may be applicable as far as it has a hidden part after processing. With the implementation of the present invention, not only the preliminary ejection onto those parts can be performed without interrupting a series of recording operations, and also an adverse effect of the preliminary ejection is made minimum in each step such as shaping and bonding of the recording medium. Furthermore, even if the preliminary ejection is performed as thus described, a quality of the original recording image will not be affected, and since these parts with the ejections do not appear outwardly after the processing, it will not spoil the appearance.

The defective ejection as described above occurs when an ink solvent component from a discharge opening used less frequently evaporates and the ink is thickened in recording operation. Here, the degree of viscosity is different by frequency in use of the discharge opening. Therefore, in order to achieve a highly qualified recording with uniformity all over range of the recording medium on which the image is formed, it is strongly desired that all of the discharge openings relating to the recording on that range are capable of showing even and good ejecting performance. To this end, it is preferable that all of those discharge openings are capable of performing a preliminary ejecting operation at an appropriate timing.

The appropriate timing for carrying out the preliminary ejection may be decided for each recording medium, or it may be decided every time when a predetermined number of recording media are recorded, based on a structure of the recording head, a property of ink, distribution of the frequency in use of the discharge openings, environmental temperature at each timing, and the like. It may also be configured such that a lapsed time is counted from the discharge opening is exposed to the air so as to start a series of recording operations, or a lapsed time is counted from the previous preliminary ejection timing, and upon reaching a preset timing, the preliminary ejection is performed.

It may also possible to allow all the discharge openings to execute the preliminary ejection simultaneously, in order to perform, so called solid recording, but it may deteriorate adhesive property in bonding, if the part subjected to the preliminary ejection includes the overlap width of the recording medium. Considering this situation, in order to prevent the image formed by the preliminary ejection from being a solid recording, it is preferable that the data for the preliminary ejection is defined appropriately so that a duty factor for recording is set to 50% or less, or an image of zigzag pattern (checker pattern) is formed. And consequently, it is preferable to complete the preliminary ejection as to all the discharge openings after recording is performed on a predetermined range.

Furthermore, data for such preliminary ejection may be supplied from the information processor 100 every timing of the preliminary ejection. Alternatively, it may be supplied in such a manner as previously included in the original image data to be recorded.

The print unit 116 used in the above embodiment is formed with recording heads having discharge openings across a predetermined range in the width direction of the recording medium. Here, the print unit 116 may be built in the overall control system, that is, it may belong to the information processor 100 and execute a recording operation under the control thereof. Alternatively, the print unit may be a print device which receives from the information processor, batch supply of data being divided into regions each associated with own position of the print unit, and which is capable of executing the print operation independently in response to a signal defining a recording timing, being supplied from the medium conveyor.

It is also possible to provide an integral full line head which satisfies the full length of the recording medium, instead of providing a plurality of print units which divide the recording area. In this case, one piece of long length recording head integrally formed may be applicable. Alternatively, a combination of plural short length recording heads may be applicable.

As an ink ejecting method from the ink jet recording head, there is a method of electric charge control type, continuous type utilizing a spray method, or on-demand type such as a thermal method utilizing heat energy as energy to carry out the ink discharge, or Piezo method which uses mechanical energy such as vibration. In any type as described above, the present invention is effective, when it is applied to a recording apparatus in a form of line printer, configured by arranging a certain number of recording elements to correspond to the recording width considering throughput. It is because in the form of line printer as described above, no usage of recording elements (discharge openings) for recording seems to be more frequent than in the case of serial type printer. In particular, in many cases, the line printer is applied for industrial recording in which it is preferable to perform the preliminary ejecting operation without interrupting the recording. However, it does not mean that the serial type recording apparatus is excluded from a target for applying the present invention. According to the present invention, it is possible to perform the preliminary ejection without moving the recording head to the outside of the recording area, and thus the present invention is also preferable in the serial type recording apparatus because it enhances the recording speed.

Preferred embodiments of the present invention have been explained so far. However, various modifications or changes may be available in addition to the above embodiments. For example, the present invention is preferable when applied to an ink jet recording apparatus using a line head. But it is also possible to apply the present invention to a serial type ink jet recording apparatus having multiple nozzles being linearly arranged, in which the recording head is scanned in the direction orthogonal to the paper conveying direction. In addition, a color recording apparatus using a plurality of recording heads has been explained, but the present invention is also applicable to a single color recording apparatus using a single recording head.

What is claimed is:

1. An ink jet recording apparatus on which a recording head is mounted, comprising, a printing means which performs printing of an image by said recording head based on image data, said recording head having a plurality of nozzles aligned therealong from which ink droplets are ejected to form the image, a preliminary on-paper ejection means which performs a preliminary ejection during printing of the image at least one time onto paper with respect to each of all the nozzles of said recording head every predetermined period, according to a predetermined preliminary on-paper ejection pattern, said predetermined period being equal to or less than one third of allowable exposure time of each of said nozzles, an ejected/non-ejected detecting means which detects whether or not an ejection has been performed within each of said predetermined period with respect to each nozzle, and a control means which sets said preliminary on-paper ejection pattern as valid in a next predetermined period subsequent to said predetermined period only for a nozzle determined as non-ejected in said ejected/non-ejected detecting means, and which transfers to said printing means print data generated based on both said preliminary ejection pattern set as valid and said image data.

2. The ink jet recording apparatus according to claim 1, wherein, said control means holds a valid flag which sets a nozzle as valid in performing the preliminary on-paper ejection, the nozzle having been determined as non-ejected by said ejected/non-ejected detecting means, and when the print data to be transferred to said recording head is generated, said preliminary on-paper ejection pattern is added to the image data so as to generate said print data, only when the valid flag indicates "valid".

3. The ink jet recording apparatus according to claim 1, wherein, said preliminary on-paper ejection pattern includes a timing of the preliminary ejection within said predetermined period, being different with respect to each of said nozzles of said recording head.

4. The ink jet recording apparatus according to claim 1, wherein, said recording head is a line head.

5. The ink jet recording apparatus according to claim 1, wherein, a first preliminary on-paper ejection mode and a second preliminary on-paper ejection mode are prepared as a preliminary on-paper ejection operation mode, said first preliminary on-paper ejection mode determining whether or not said preliminary on-paper ejection every predetermined period is necessary based on a detection result of said ejected/non-ejected detecting means, and said second preliminary on-paper ejection mode performing the preliminary on-paper ejection constantly while printing regardless of the detection result of said ejected/nonejected detecting means, and said first and said second preliminary on-paper ejection modes are utilized by switching therebetween, according to the number of pixels to be printed by said recording head.

* * * * *